US011097336B2

(12) United States Patent
Gravier et al.

(10) Patent No.: US 11,097,336 B2
(45) Date of Patent: Aug. 24, 2021

(54) DEVICE AND METHOD FOR PRODUCING METAL SLUGS

(71) Applicants: UNIVERSITE GRENOBLE ALPES, Saint Martin d'Heres (FR); INSTITUT POLYTECHNIQUE DE GRENOBLE, Grenoble (FR)

(72) Inventors: Sébastien Gravier, Saint Martin d'Heres (FR); Georges Kapelski, Vaulnaveys le Haut (FR)

(73) Assignees: UNIVERSITE GRENOBLE ALPES, Saint Martin d'Heres (FR); INSTITUT POLYTECHNIQUE DE GRENOBLE, Grenoble (FR)

( * ) Notice: Subject to any disclaimer, the term of this patent is extended or adjusted under 35 U.S.C. 154(b) by 0 days.

(21) Appl. No.: 16/631,650

(22) PCT Filed: Jul. 9, 2018

(86) PCT No.: PCT/EP2018/068574
§ 371 (c)(1),
(2) Date: Apr. 14, 2020

(87) PCT Pub. No.: WO2019/016015
PCT Pub. Date: Jan. 24, 2019

(65) Prior Publication Data

US 2020/0238369 A1 Jul. 30, 2020

(30) Foreign Application Priority Data

Jul. 17, 2017 (FR) ..... 1756745

(51) Int. Cl.
*B22D 5/02* (2006.01)
*B22D 11/06* (2006.01)
(Continued)

(52) U.S. Cl.
CPC ..... *B22D 5/02* (2013.01); *B22D 11/064* (2013.01); *B22D 27/04* (2013.01); *B22D 27/15* (2013.01); *B22D 39/06* (2013.01)

(58) Field of Classification Search
CPC ... B22D 5/00; B22D 5/02; B22D 5/04; B22D 11/064; B22D 27/04; B22D 27/15; B22D 39/06
See application file for complete search history.

(56) References Cited

U.S. PATENT DOCUMENTS 650,372 A 5/1900 Croxton
2,595,780 A 5/1952 Dunlap, Jr.
(Continued)

FOREIGN PATENT DOCUMENTS

DE 1239066 B 4/1967
FR 2290266 A1 6/1976
(Continued)

OTHER PUBLICATIONS

International Search Report from corresponding International Application No. PCT/EP2018/068574, dated Sep. 2018, pp. 1-3, European Patent Office, Rijswijk, The Netherlands.
(Continued)

*Primary Examiner* — Kevin P Kerns
*Assistant Examiner* — Steven S Ha
(74) *Attorney, Agent, or Firm* — Hauptman Ham, LLP

(57) ABSTRACT

A device and method for producing metal slugs, in which: a movable support has a plurality of cavities separated by partition walls, such that the cavities travel over a path, a feeding means is positioned above a location on said path and is capable of forming a stream of molten metal, flowing under the effect of gravity, such that, during the continuous movement of the movable support, the continuous stream of molten metal from the feeding means is divided or frag-
(Continued)

mented into slugs formed successively in said cavities, under the effect of said partition walls.

13 Claims, 5 Drawing Sheets

(51) Int. Cl.

| | |
|---|---|
| ***B22D 27/04*** | (2006.01) |
| ***B22D 27/15*** | (2006.01) |
| ***B22D 39/06*** | (2006.01) |

(56) References Cited

U.S. PATENT DOCUMENTS

| | | | |
|---|---|---|---|
| 3,993,119 | A | 11/1976 | Scott |
| 4,589,467 | A | 5/1986 | Hunter |
| 2009/0308560 | A1 | 12/2009 | Graham |

FOREIGN PATENT DOCUMENTS

| | | | | |
|---|---|---|---|---|
| GB | 1444002 | A | | 7/1976 |
| JP | 02137657 | A | * | 5/1990 |
| WO | 2013141879 | A1 | | 9/2013 |

OTHER PUBLICATIONS

Written Opinion from corresponding International Application No. PCT/EP2018/068574, pp. 1-10, European Patent Office, Rijswijk, The Netherlands.

* cited by examiner

DEVICE AND METHOD FOR PRODUCING METAL SLUGS

CROSS-REFERENCE TO RELATED APPLICATIONS

The present application is a National Phase of International Application No. PCT/EP2018/068574, filed on Jul. 9, 2018, which claims priority to French Application No. 1756745, filed Jul. 17, 2017, which is incorporated herein by reference.

DOMAIN OF THE INVENTION

Embodiments of the present invention relate to the field of producing metal slugs.

It is specified that the name "metal slugs" is applied to metal masses intended to be shaped, generally hot-shaped, in view of producing particular metal objects or parts, for example by injection, forging, die cutting, moulding or other, and being presented in particular in the form of discs, rollers or beads.

It is also specified that the name "metal materials" is applied to metals or metal alloys, whatever the compositions thereof and the states thereof.

It is also specified that the name "metal glasses" is applied to metal materials which are not crystalline and is applied also to metal materials which are partially crystalline and which, therefore, contain a mass or volume fraction of crystals, generally less than 50%.

It is known to produce metal slugs by extruding a molten metal material contained in a melting pot, through an extrusion orifice arranged through the bottom of a melting pot.

TECHNOLOGICAL BACKGROUND

According to an extrusion method described, for example, in patents U.S. Pat. No. 2,595,780 and EP 0 136 866, the molten metal or molten metal alloy which exits the extrusion orifice is segmented naturally by beading.

According to another extrusion method described in patent WO 2013/141879, the molten metal or molten metal alloy flows by gravity from the extrusion orifice by forming a stream which is segmented under the effect of a magnetic field.

Then, the metal slugs which fall are cooled by ambient gas and/or during the penetration thereof in a cooling liquid.

The extrusion methods above can be, in particular, applied to producing small metal glass slugs, generally not exceeding millimetric dimensions when they are cooled in a gas and or larger dimensions when they are cooled in a liquid. When they are cooled in a liquid, there is a problem of polluting the material constituting the slugs by the liquid.

Patent US 2009/0308560 describes a moulding device which comprises a plurality of moulding buckets arranged over a circumference and moved in rotation and a trough to pour the liquid metal successively into the buckets during the movement in rotation of the buckets along this circumference. The parts formed are extracted by successive tilting towards the base of the buckets.

Patent FR 2 290 266 describes a moulding device which comprises an endless chain provided with plates extending outwards. Along an upper path, the plates are brought together and together form moulding cavities, which are successively filled with a liquid metal from a pouring spout of a tilting tank. The parts formed are removed at a reversal end of the endless chain, when the plates are moved away from one another.

However, there are still difficulties for obtaining metal slugs, of which the volume is precisely calibrated and which are not degraded or polluted, in particular when this relates to obtaining metal glass slugs, these difficulties being considerably increased when the metal slugs to be obtained must have greater volumes, for example of around a few cubic millimetres to a few cubic centimetres.

SUMMARY

A device for producing metal slugs is proposed, which comprises a movable support having a plurality of cavities separated by partition walls, such that the cavities travel over a path; and a feeding means, equivalently described as feeding element, positioned above a location of said path and capable of forming a stream of molten metal, flowing under the effect of gravity, such that during the continuous movement of the movable support, the continuous stream of molten metal from the feeding means is divided or fragmented into slugs formed successively in said cavities, under the effect of said partition walls.

The feeding means comprises a melting pot capable of receiving the metal material and provided with at least one lower extrusion orifice, a means for heating, equivalently described as heating element the metal material contained in the melting pot and a pressure means, equivalently described as pressure element acting on the surface of the metal contained in the melting pot.

Thus, the material quantity constituting the slugs can be controlled and the slugs can be cooled in contact with the plate.

The movable support can comprise a rotating plate, said cavities formed on an annular zone of this plate.

The device can comprise removal means, equivalently described as removal element capable of removing the metal slugs formed from the cavities.

Said removal means can comprise pushbuttons mounted on the plate and a cam for actuating these pushbuttons.

Said removal means can comprise at least one nozzle capable of generating a gas jet.

Said removal means can comprise a diverting slat.

The plate can comprise at least one peripheral annular collar having an upper face capable of receiving the slugs extracted from the cavities.

The device can comprise means for removing slugs arranged on said collar.

Said cavities can have respectively a bottom and can be internally delimited by a common annular partition protruding upwards and circumferentially by partition walls which separate them, these partition walls could extend in the direction of the axis of rotation upwards from the bottoms and radially outwards from the common annular partition, such that the cavities are open upwards and radially outwards, opposite the common annular partition and are of equivalent shapes.

The device can comprise removal means, equivalently described as removal element, capable of removing from the cavities, radially outwards, the metal slugs formed.

The bottoms of the cavities can extend in one same approximately radial plane, the upper edges of the partition walls could extend in one same radial plane and the partition walls could be distributed along equal circumferential steps.

The bottoms of the cavities can be inclined in the direction of the common annular partition.

The movable support can comprise a plurality of support elements connected together in an articulated manner, by forming an endless chain having an upper strand, said support elements having at least one cavity, the feeding means being positioned above a location of the path of said upper strand.

Said pressure means can comprise a piston.

Said pressure means can comprise a pressurised gas.

The device can comprise means for cooling said movable support, equivalently described as cooling element.

The device can be installed in a vacuum enclosure or an enclosure containing a neutral gas.

The metal can be capable of forming an at least partially amorphous metal glass.

A method for producing metal slugs is also proposed, which comprises: forming a continuous stream of molten metal material, through at least one lower orifice for extruding a melting pot containing the metal material and under the effect of a pressure means acting on the surface of the metal contained in the melting pot; letting the stream of molten metal flow, under the effect of gravity, above a path on which cavities of a movable support continuously travel, separated by partition walls, such that the stream of molten metal is divided or fragmented into slugs formed successively in said cavities, under the effect of said partition walls.

BRIEF INTRODUCTION OF THE DRAWINGS

Device for producing metal slugs will now be described as non-limiting embodiment examples, illustrated by the appended drawing, in which.

DETAILED DESCRIPTION

Figure 1:
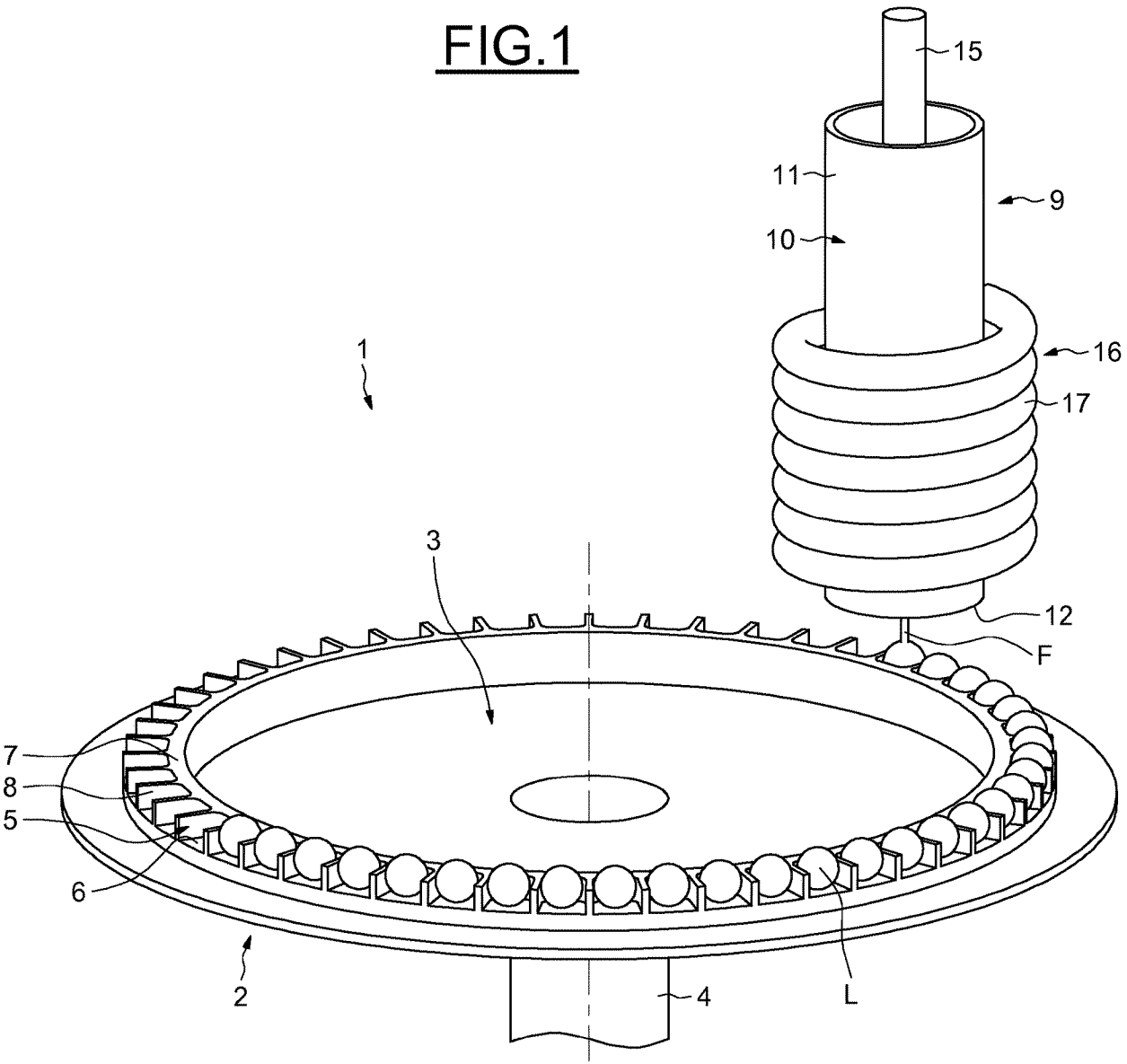
FIG. 1 represents a partial, perspective view of a device for producing metal slugs, in a situation.

According to an embodiment example illustrated in FIGS. 1 to 4, a device 1 for producing metal slugs, comprises a metal movable support 2 constituted by a rotating, radial, circular plate 3 carried by a vertical shaft 4 and extending radially to this shaft.

The shaft 4 is connected to an electric or hydraulic drive means, equivalently described as electric or hydraulic drive element (not represented) to drive in rotation the plate 2 at a controlled rotation speed.

Over an annular zone of the plate 3 is arranged a plurality of cavities 5 such that the cavities 5 travel over an annular or circular path when the plate 3 rotates.

The cavities 5 respectively have a bottom 6 and are internally delimited by a common annular partition 7 protruding upwards and circumferentially through the partition walls 8 which separate them, these partition walls extending in the direction of the axis of rotation upwards from the bottoms 6 and radially outwards from the common annular partition 7.

The upper edges of the partition walls 8 extend in one same radial plane.

Figure 2:
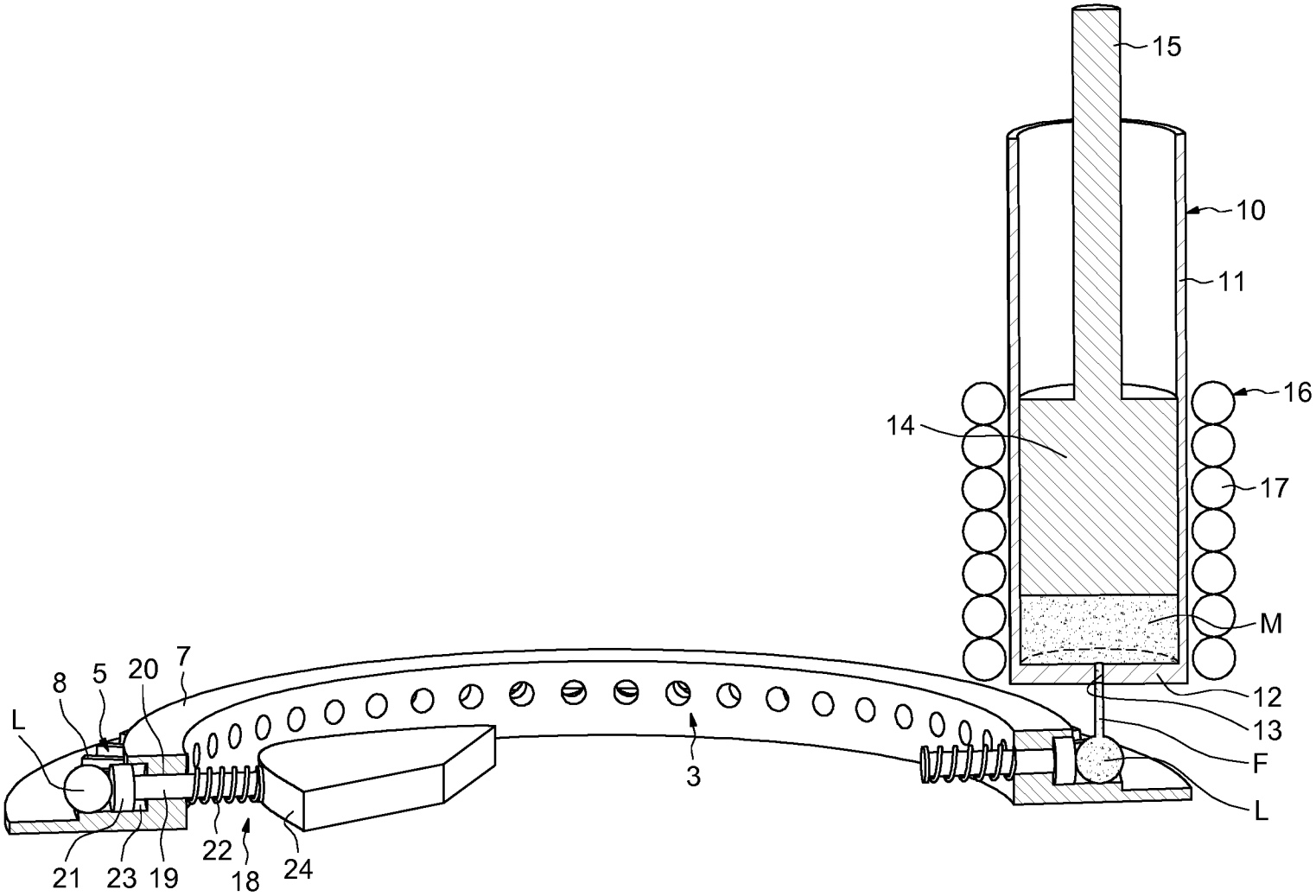
FIG. 2 represents a perspective and cross-sectional view of the device of FIG. 1, including an ejection means, or equivalently ejection element.
Figure 3:
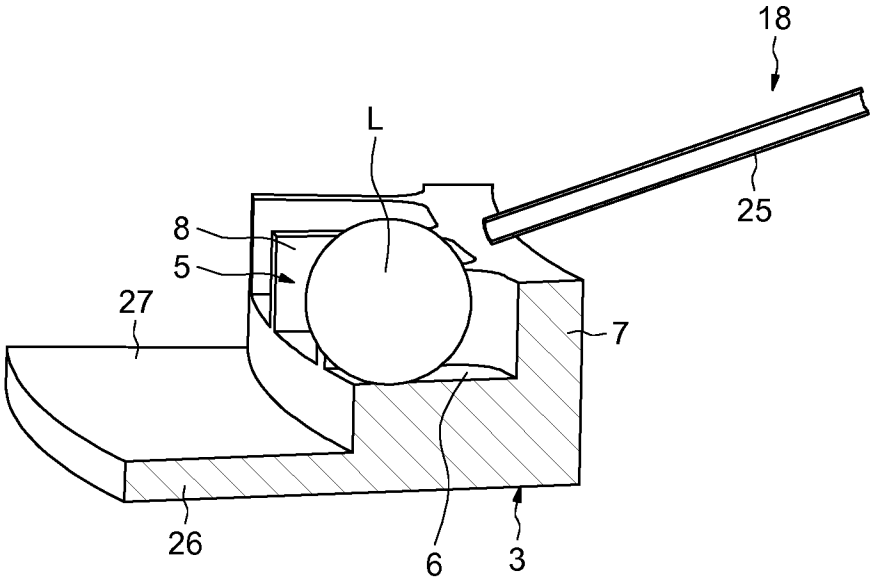
FIG. 3 represents a perspective and cross-sectional view of a detail of the device of FIG. 1, including another ejection means.

According to a configuration illustrated in FIGS. 1 to 3, the bottoms 6 of the cavities 5 extend approximately in one same radial plane.

Figure 4:
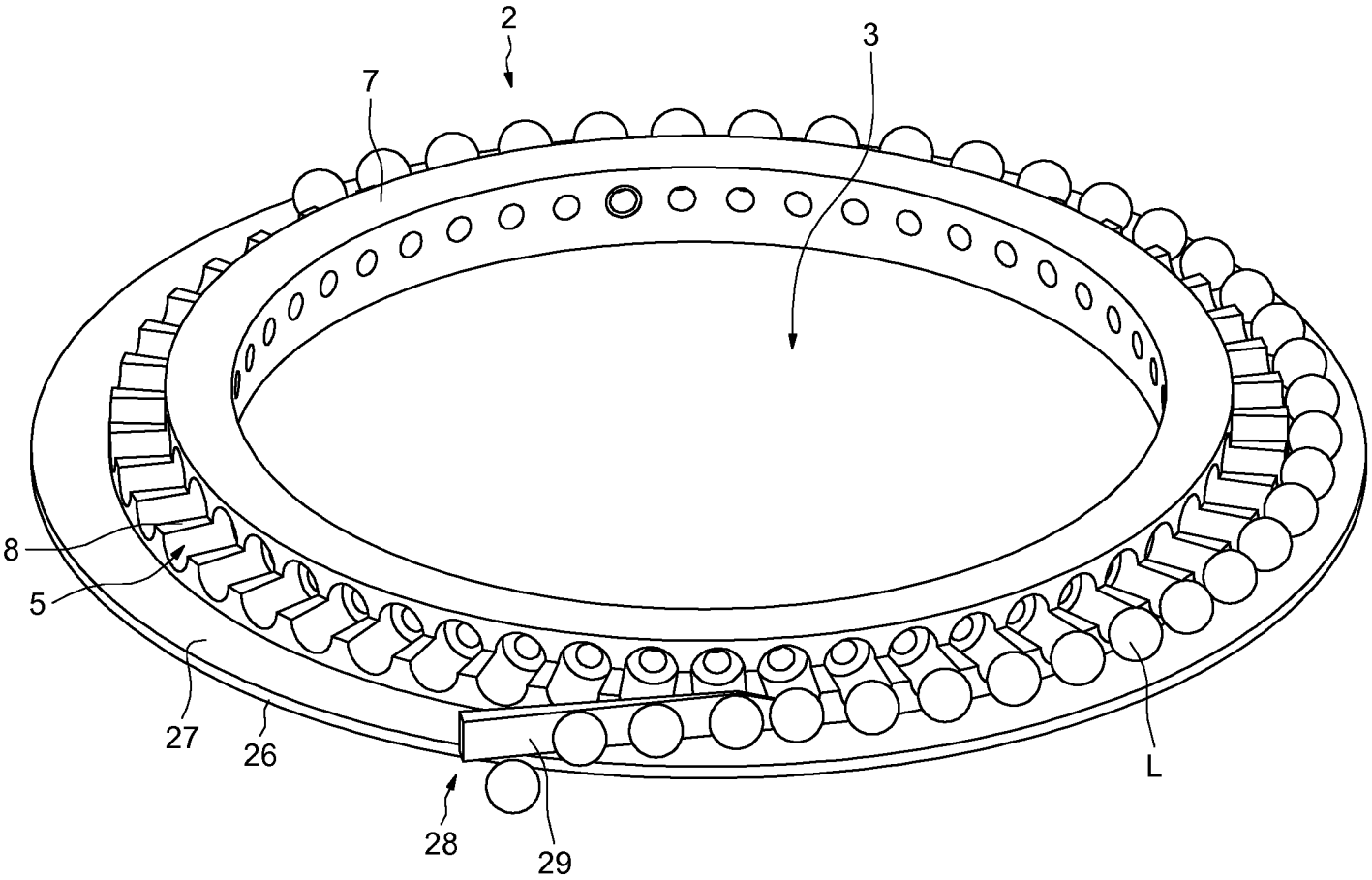
FIG. 4 represents a partial, perspective view of the device of FIG. 1, in another situation.

According to another configuration illustrated in FIG. 4, the bottoms 6 of the cavities 5 are radial trough-shaped situated above and adjacent to one same radial plane.

However, the bottoms 6 of the cavities 5 can be slightly inclined by a few degrees in the direction of the common annular partition 7.

Thus, the cavities 5 are open upwards and radially outwards, opposite the common annular partition 7 and are of equivalent shapes.

Advantageously, the partition walls 8 are distributed along equal circumferential steps, such that the cavities 5 are identical.

The upper portion of the partition walls 8 is thin, even pointed out and/or notched, so as to be capable of producing a partitioning (shearing) effect as will be described below.

The device 1 comprises a feeding means 9, equivalently described as feeding element, positioned above a location of the annular path of the cavities 5.

The feeding means 9 comprises a melting pot 10 which comprises a vertical cylindrical wall 11 and a lower radial bottom 12 provided, for example in the middle thereof, with an extruding through orifice 13 which is situated approximately radially in the middle of the annular path of the cavities 5.

In the melting pot 10, a piston 14 can be engaged, of which the upper rod 15 is connected to a driving in vertical translation element (not represented).

The melting pot 10 is equipped with a heating means 16, equivalently described as heating element, constituted, for example, by induction spires 17 which surround the cylindrical wall 11.

The device 1 functions as follows.

In the melting pot 10, pieces of a metal material M, such as one metal, several metals or a metal alloy, are deposited.

The piston 14 is engaged in the melting pot 10.

Under the effect of the heating means 16, the metal material is heated under this material melts, at least partially.

The plate 3 is put into continuous rotation.

Under the effect of the piston 14, a pressure is exerted on the upper face of the metal material M contained in the melting pot 10. In this manner, the molten metal material is extruded through the extrusion orifice 13 of the melting pot 10 and flows towards the base under the effect of gravity, in the form of a continuous stream F of molten metal material. According to an embodiment variant, the piston 14 could be replaced by a gas exerting a pressure on the free surface of the metal in the melting pot 10.

When it reaches the path of the continuously moving cavities 5, in the course of the flow, progressively and successively. The stream F of molten metal material penetrates into the cavities 5 and is thus divided or segmented, under the effect of the partition walls 8, to form metal slugs L which take place on the bottoms 6 of the cavities 5, by being possibly in contact with the corresponding portions of the annular partition 7 and the corresponding partition walls 8.

After which, the metal slugs L formed, which are brought by the rotating plate 3, take a rounded shape under the effect of surface tensions, cool and solidify in contact with the plate 3. In the case where the device 1 is in a gas, this gas can contribute to the cooling.

The plate 3 can be provided with channels (not represented) connected by a rotating joint to a source (not represented) of a cooling fluid.

From the above, it results that the quantity, in particular by weight, of metal material constituting each slug L is directly a function of the flow speed and of the section of the stream F, of the circumferential movement speed of the cavities 5 and of the circumferential step for separating the partition walls 8.

Insofar as the circumferential movement speed of the cavities 5 is constant, corresponding to a constant rotation speed of the plate 3, and insofar as the flow speed and the section of the stream F are constant, while the slugs L formed comprise the same metal material quantity.

The device 1 also comprises extraction means 18, equivalently described as extraction element, capable of extracting the metal slugs L from the cavities 5, solidified at least at the periphery thereof, in an extraction location situated before the slugs L reach the location where the stream F of molten metal material is found to be formed, from the melting pot 10.

According to an embodiment variant illustrated in FIG. 2, the extraction means 18 comprise a plurality of radial pushbuttons 19 which extend through radial passages 20 arranged through the portions of the common annular partition 7 corresponding to the cavities 5. The radial pushbuttons 19 have shoulders 21 situated on the side of the cavities 5 and are subjected to springs 22 on the inner side of the annular partition 7.

Apart from the extraction location, the pushbuttons occupy a retracted position inwards, in which the shoulders 21 are engaged in recesses 23 of the annular partition 7 under the effect of springs 22, leaving the cavities 5 free.

When they pass successively to the extraction location, the radial pushbuttons 19 are subjected to a fixed cam 24 which acts on the inner end of the pushbuttons situated on the inner side of the annular partition 7. Successively, under the effect of the cam 24, the radial pushbuttons 19 travel radially against the springs 22 in a movement going outwards and returning inwards. During the movement going outwards, the radial pushbuttons 19 push the corresponding metal slugs L radially outwards and extracted the latter from the corresponding cavities 5.

According to another embodiment variant illustrated in FIG. 3, the extraction means 18 comprise a nozzle 25 connected to a source of a pressurised gas source and of which an end is situated above and in the proximity of the annular partition 7, in the extraction location, and is oriented towards the path of the cavities 5. Under the effect of the gas jet exiting from the nozzle 25, the slugs L are successively extracted from the cavities 5, radially outwards.

According to another embodiment variant, insofar as the slugs L travel upwards, the slugs L could be extracted under the effect of a slat positioned above the cavities 5 in the extraction location.

The slugs L extracted from the cavities 5 in the extraction location, can be removed by falling directly into a recovery vessel. In this case, the residence time of the slugs L on the plate 3, between the feeding location and the extraction location is sufficient such that the slugs L are sufficiently cooled and sufficiently solidified from the periphery thereof.

However, it can be advantageous to increase the residence time of the slugs L on the plate 3, such that the slugs L are sufficiently cooled and sufficiently solidified before the removal thereof.

For this, the plate 3 comprises a peripheral annular collar 26 having an annular upper face 27 situated at the periphery of the cavities 5, at the same level of or slightly below the bottoms 6 of the cavities 5. The annular upper face 27 can be radial or slightly inclined inwards by a few degrees.

The slugs L extracted successively from the cavities 5 in the extraction location are successively positioned on the upper face 27 of the annular collar 26 and are moved during the rotation of the plate 3.

According to an embodiment variant illustrated in FIG. 4, the device 1 further comprises means for removing 28 slugs L, equivalently described as removal element, positioned on the collar 26, in a removal location situated before the slugs L reach the extraction location where they are extracted from the cavities 5.

The removal means 28 comprise a diverting slat 29 which extends above and at a small distance from the peripheral annular collar 26.

When the slugs L meet the diverting slat 29, they are diverted radially outwards in the course of the rotation of the plate 3 and are removed. The removed slugs L fall, for example, into a recovery vessel.

According to another embodiment variant, the removal means 28 could comprise a nozzle producing a gas jet capable of removing the slugs L.

According to another embodiment variant, to also increase the residence time of the slugs L on the plate 3, the plate 3 could comprise several radially successive peripheral annular collars, the slugs L pass from one collar to the other under the effect of successive removal means.

Figure 5:
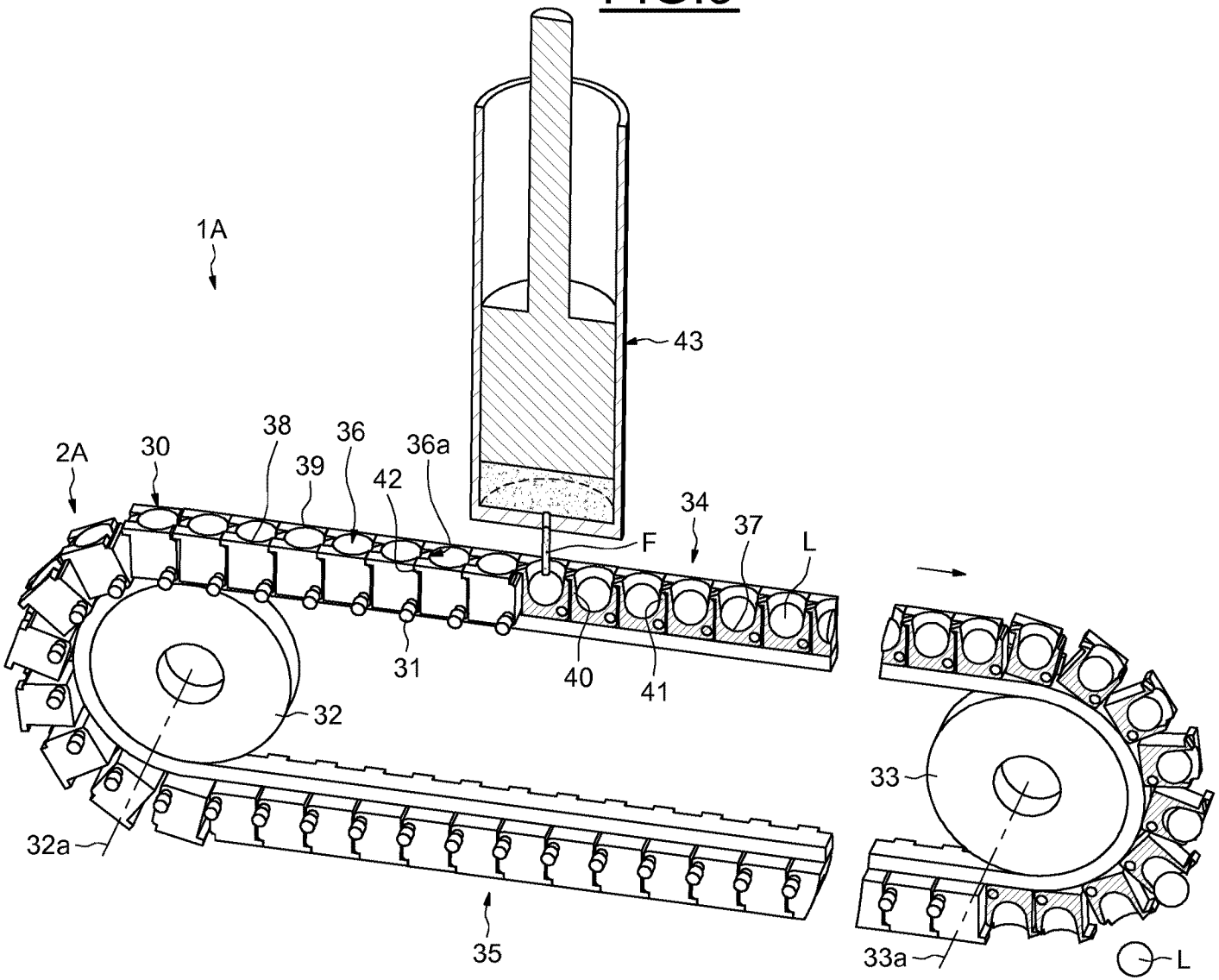
FIG. 5 represents a perspective view of another device for producing metal slugs.

According to another embodiment example illustrated in FIG. 5, another device 1A for producing metal slugs, comprises a metal movable support 2A constituted by a plurality of articulated support elements 30 against one another, by way of transversal axes of articulation 31, by forming an endless chain carried by return pulleys 32 and 33 spaced horizontally and mounted on parallel transversal axes 32*a* and 33*a*, such that this endless chain has an upper strand 34 and a lower strand 35. One of the axes 32*a* and 33*a* is connected to an electric or hydraulic means for driving in rotation, so as to continuously drive the endless chain constituted by the support elements 30.

The support elements 30 comprise blocks in each of which is formed a cavity 36 open outwards with respect to the path of the endless chain. The cavities 36 travel over one same circumferential path and are identical.

The cavities 36 have a bottom 37 and are delimited by opposite side walls 38 and 39 and opposite transversal walls 40 and 41. The end edges of the transversal walls 41 have edges 42 capable of coming above the end edges of the transversal walls 40.

The adjacent transversal walls 40 and 41 of two successive support elements 30 are born against one another when the support elements 30 are situated on the upper strand 34, the edges 42 covering the end edges of the transversal walls 40. The contiguous adjacent transversal walls 40 and 41 successively constitute partition walls 36*a*, separating the cavities 36.

When the support elements 30 circumvent the return pulleys 32 and 33, the transversal walls 40 and 41 move away from one another by forming spacing Vs. When the support elements 30 are situated on the lower strand 35, the transversal walls 40 and 41 can be in contact or slightly moved away by forming spacing V [[Vs]].

The device 1A comprises a feeding means 43, equivalent to the means for feeding by extrusion 9, capable of forming a continuous stream F of a molten metal material, following towards the base. The feeding means 43 is positioned in a feeding location situated above and at a distance from the upper strand 34, in a position such that the continuous stream F flows above the median portion of the path of the cavities 36.

The device 1A functions as follows.

Equivalently to the preceding embodiment example, when the continuous stream F of molten metal material, from the feeding device 43, reaches the path of the cavities 36 of the support elements 30, in continuous straight movement along the upper strand 34, progressively and successively, the continuous stream F of molten metal material penetrates into the cavities 36 and is divided or segmented, under the effect of the upper edges of the partition walls 36*a* constituted by the upper edges of the transversal walls 40 provided with edges 42, to form metal slugs L which take place on the bottoms 37 of the corresponding cavities 36, by being possibly in contact with the walls 38, 39, 40 and 41.

After which, the metal slugs L formed take a rounded shape under the effect of surface tensions, are cooled and are solidified, at least partially, in contact with the plate 3 and with the gas which surrounds it.

The device 1A can be equipped with means for cooling the support elements 30, equivalently described as cooling element. For example, these cooling means can comprise one or more fixed nozzles (not represented) connected to a source (not represented) of a cooling gas, generating cooling gas jets towards the support elements 30, for example over some of the path thereof.

The metal slugs L formed are brought by the support elements 30 in translation along the upper strand 34, then in rotation on the return pulley 33.

During the reversal of the support elements 30 on the return pulley 33, the metal slugs L would successively be extracted from the cavities 36 under the effect of gravity and fall, for example, into a recovery vessel (not represented).

From the above, it results that the quantity, in particular by weight, of metal material constituting each slug L is directly a function of the flow speed and of the section of the stream F, of the linear movement speed of the cavities 5 along the upper strand and of the step for separating the partition walls constituted by the adjacent transversal walls 40 and 41.

Insofar where the linear movement speed of the cavities 36 is constant, corresponding to a constant rotation speed of the return pulley 32 and 33, and insofar as the flow speed and the section of the stream F are constant, thus, the slugs L formed comprise the same metal material quantity.

The devices 1 and 1A can be housed inside controlled, neutral atmosphere enclosures opposite the metal material implemented or under vacuum. The gases possibly used to cool the supports 2 and 2A, the gases possibly used to cool the slugs L during formation formed and the gases possibly used to remove the slugs L formed can be neutral opposite the metal material implemented.

The devices 1 and 1A can advantageously be used to produce metal slugs L made of metal glasses or made of materials capable of forming metal glasses, in particular with a zirconium (Zr), magnesium (Mg), iron (Fe), copper (Cu), aluminium (Al), palladium (Pd), platinum (Pt), titanium (Ti), cobalt (Co) base. For example, the weight of the slugs L formed can be of between one gram and twenty grams.

The invention claimed is:

1. A device for producing metal slugs, comprising:

a movable support having a plurality of cavities separated by partition walls, such that the cavities travel over a path, the movable support comprising a rotating plate, said cavities being formed on an annular zone of the rotating plate, and a feeding element positioned above a location of said path and capable of forming a stream of molten metal, flowing under the effect of gravity, such that during the continuous movement of the movable support, the continuous stream of molten metal from the feeding element is divided or fragmented into slugs formed successively in said cavities, under the effect of said partition walls;

wherein the feeding element comprises a melting pot capable of receiving the metal material and provided with at least one lower extrusion orifice, a heating element configured to heat the metal material contained in the melting pot and a pressure element configured to act on the surface of the metal contained in the melting pot, and wherein the rotating plate comprises at least one peripheral annular collar having an upper face capable of receiving the slugs extracted from the cavities.

2. The device according to claim 1, comprising a removal element capable of removing the metal slugs formed from the cavities.

3. The device according to claim 2, in which said removal element comprises pushbuttons mounted on the rotating plate and a cam for actuating said pushbuttons.

4. The device according to claim 2, in which said removal element comprises at least one nozzle capable of generating a gas jet.

5. The device according to claim 2, in which said removal element comprises a diverting slat.

6. The device according to claim 1, further comprising a removing slugs element arranged on said at least one collar.

7. The device according to claim 1, in which said cavities each have a bottom and are internally delimited by a common annular partition protruding upwards and circumferentially through the partition walls which separate them, these partition walls extending in the direction of the axis of rotation upwards from the bottoms and radially outwards from the common annular partition, such that the cavities are open upwards and radially outwards, opposite the common annular partition and are of equivalent shapes, and comprising a removal element capable of removing from the cavities, radially outwards, the metal slugs formed.

8. The device according to claim 1, in which said cavities each have a bottom and are internally delimited by a common annular partition protruding upwards and circumferentially through the partition walls which separate them the bottoms of the cavities extend into one same approximately radial plane, and the upper edges of the partition walls extend in one same radial plane and the partition walls are distributed along equal circumferential steps.

9. The device according to claim 1, in which said cavities each have a bottom and are internally delimited by a common annular partition protruding upwards and circumferentially through the partition walls which separate them, and the bottoms of the cavities are inclined in the direction of the common annular partition.

10. The device according to claim 1, in which said pressure element comprises a piston.

11. The device according to claim 1, in which said pressure element comprises a pressurised gas.

12. The device according to claim 1, comprising a cooling element of said movable support.

13. A method for producing metal slugs comprising:

forming a continuous stream of molten metal material, through at least one lower extrusion orifice of a melting pot containing the metal material and under the effect of a pressure element acting on the surface of the metal contained in the melting pot; and letting the stream of molten metal flow, under the effect of gravity, above a path over which cavities of a movable support continuously travel, separated by partition walls, such that the stream of molten metal is divided or segmented in slugs formed successively in said cavities, under the effect of said partition walls; and extracting the slugs from the cavities in an extraction location situated before the slugs reach the location where the continuous stream of molten metal material is formed, for the slugs to be positioned on at least one peripheral annular collar having an upper face capable of receiving the slugs extracted from the cavities.

* * * * *